US008522470B2

(12) United States Patent
Mangum

(10) Patent No.: US 8,522,470 B2
(45) Date of Patent: Sep. 3, 2013

(54) REAR RIFLE STABILIZER

(71) Applicant: Neil H Mangum, Newnan, GA (US)

(72) Inventor: Neil H Mangum, Newnan, GA (US)

( * ) Notice: Subject to any disclaimer, the term of this patent is extended or adjusted under 35 U.S.C. 154(b) by 0 days.

(21) Appl. No.: 13/629,564

(22) Filed: Sep. 27, 2012

(65) Prior Publication Data

US 2013/0081317 A1 Apr. 4, 2013

Related U.S. Application Data

(60) Provisional application No. 61/542,173, filed on Oct. 1, 2011.

(51) Int. Cl.
*F41C 27/00* (2006.01)

(52) U.S. Cl.
USPC ..... 42/94; 89/37.04

(58) Field of Classification Search
USPC ..... 42/94, 90; 89/37.01, 37.04, 37.09
See application file for complete search history.

(56) References Cited

U.S. PATENT DOCUMENTS

| | | | | |
|---|---|---|---|---|
| 4,409,751 | A | 10/1983 | Goda et al. | |
| 4,876,814 | A | 10/1989 | Lombardo | |
| 4,987,694 | A | 1/1991 | Lombardo | |
| 5,490,302 | A | 2/1996 | Dion | |
| 5,819,461 | A | 10/1998 | Killian | |
| 5,937,560 | A | 8/1999 | Beltz | |
| 6,305,116 | B1 | 10/2001 | Parker | |
| 6,510,573 | B1 | 1/2003 | Grabe | |
| 6,681,974 | B2 | 1/2004 | Rotter | |
| 6,772,549 | B2 | 8/2004 | Muhlestein | |
| 6,860,054 | B1 | 3/2005 | Mosher | |
| 7,866,081 | B2 | 1/2011 | Seuk | |
| 7,917,972 | B1 | 4/2011 | Krueger | |
| 8,104,212 | B2 * | 1/2012 | Potterfield et al. | 42/94 |
| 2012/0246991 | A1 * | 10/2012 | Seuk | 42/94 |

* cited by examiner

*Primary Examiner* — J. Woodrow Eldred
(74) *Attorney, Agent, or Firm* — Christopher Wood; Premier Law Group, PLLC

(57) ABSTRACT

The invention relates generally to stabilizers for rifles. More specifically, the invention is a rear rifle stabilizer (RRS) designed to replace the current methods of stabilizing a rifle for accurate fire. The RRS comprises a base block having a recess at the top thereof such as a curved U-shaped or V-shaped recess. Lining the recess is an air bladder operatively connected to a hand operated air pump and release valve capable of very minor movement. The purpose of the air bladder is to give the shooter the ability to make very small adjustments in elevation without taking his/her eye away from the sights of the rifle or make any major body movements.

9 Claims, 5 Drawing Sheets

REAR RIFLE STABILIZER

CROSS-REFERENCE TO RELATED APPLICATIONS

This application claims the benefit of priority from U.S. Provisional Patent Application Ser. No. 61/542,173 ( i.e., Oct. 1, 2011). The entire content of Provisional Patent Application Ser. No. 61/542,173 is incorporated herein by reference in its entirety.

STATEMENT REGARDING FEDERALLY SPONSORED RESEARCH OR DEVELOPMENT

Not Applicable.

FIELD OF THE INVENTION

This invention is directed to stabilizers for rifles. More specifically, the invention is a rear rifle stabilizer (RRS) which functions by stabilizing a rifle's buttstock.

BACKGROUND OF THE INVENTION

Currently there are two popular methods of stabilizing a rifles buttstock. One is the sand sock and the other is a threaded bolt device that is used to raise and lower the rifle buttstock.

In the sand sock method a sock or cloth bag is filled with sand or beads to the desired level for a soft or hard support, usually one of each. The sock/socks are placed under the buttstock of the rifle with the non-shooting hand. The rifle is rested on the socks at the desired level to acquire a target. If the rifles barrel needs to be raised for targets further away the shooter releases his grip on the sock allowing the buttstock of the rifle to lower. If the barrel of the rifle needs to be lower the shooter increases his grip on the sock pushing the buttstock up.

The threaded bolt device for lowering and/or raising the buttstock employs bolt device that is fixed on the rifle. It is a threaded bolt screwed into a cylinder with a base plate at the bottom. This device is worked by twisting the cylinder around the bolt and lowering or raising the rifle buttstock.

A brief review of the prior art follows.

U.S. Pat. No. 6,860,054 discloses a pneumatic gun alignment system for accurately adjusting a gun position. The pneumatic gun alignment system includes a support bag having an air bag positionable beneath a firearm, and an air supply fluidly connected to the air bag for supplying pressurized air to the air bag. A valve unit is preferably positioned within the hose for allowing the user to slowly release air from the air bag and for maintaining a desired amount of air within the air bag. The user increases the air pressure to elevate the firearm and decreases the air pressure to lower the firearm.

U.S. Pat. No. 4,409,751 discloses a firearm support for holding and steadying a small arm such as a rifle. The firearm support includes a barrel support for supporting the barrel end of the firearm, a stock support for supporting the stock of the firearm and at least one adjustable slider rod interconnecting the barrel support with the stock support.

U.S. Pat. No. 5,819,461 describes an apparatus that helps a user to steadily hold a pointable device, such as a camera, a telescope, or a gun. It includes an arm rest having upper and lower portions, respectively, for supporting an upper arm from below and for restricting rotation of a lower arm bent at the elbow. The upper and lower arm holding portions each can press against a user's arm from enough directions to retard motion of the arm perpendicular to its length. The upper and lower portions can include cylindrical inner surfaces angled to bend an arm at least sixty degrees at the elbow. A support holds the arm rest from below. The support can include a rigid elongated member. In some embodiments, this member reaches to the ground. In many others, it rests against a user's hip and has a lower end designed to be supported by a pocket, belt, or Velcro pad on the user's hip. It is preferred that the elongated member slant down and in toward the hip from the arm rest at an adjustably fixed angle and that the lower arm holding portion be supported in a diagonal direction which points both up and in toward a position in front of the user's face. The apparatus often includes a mounting for the pointable device, preferably one which can be rotated with two degrees of freedom, and one the height of which relative to the arm rest can be adjustably fixed.

None of the above inventions and patents, taken either singly or in combination, is seen to describe the instant invention as claimed.

SUMMARY

The invention relates generally to stabilizers for rifles. More specifically, the invention is a rear rifle stabilizer (RRS) designed to replace the current methods of stabilizing a rifle for accurate fire. The RRS comprises a base block having a recess at the top thereof such as a curved U-shaped or V-shaped recess. Lining the recess is an air bladder operatively connected to a hand operated air pump and release valve capable of very minor movement. The purpose of the air bladder is to give the shooter the ability to make very small adjustments in elevation without taking his/her eye away from the sights of the rifle or make any major body movements.

BRIEF DESCRIPTION OF THE DRAWINGS

Similar reference characters denote corresponding features consistently throughout the attached drawings.

DESCRIPTION OF THE PREFERRED EMBODIMENTS OF THE INVENTION

Figure 1:
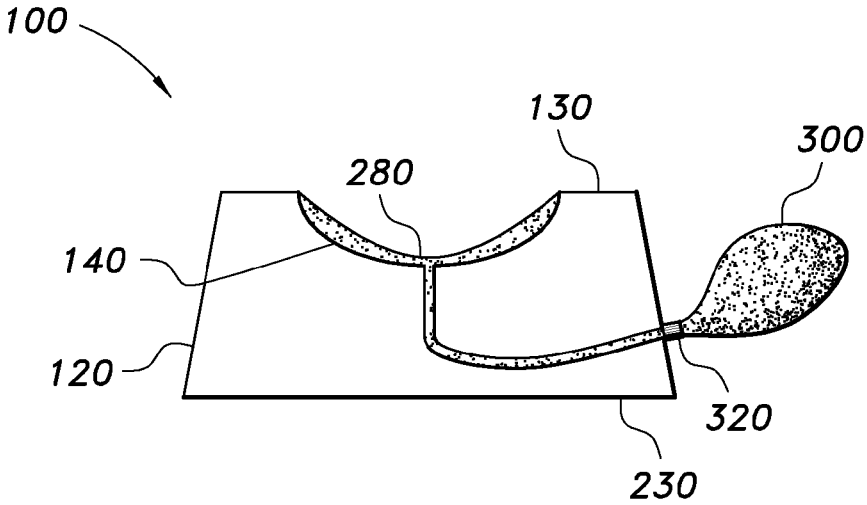
FIG. 1 shows an end view of a rear rifle stabilizer according to the invention.

This invention is directed to stabilizers for rifles. More specifically, the invention is a rear rifle stabilizer (RRS) denoted generally by the numeric label "100". The terms "rear rifle stabilizer" and "RRS" are used interchangeably.

Referring to FIGS. 1 through 5, the rear rifle stabilizer 100 comprises a base block 120. The base block 120 defines a top surface 130. A recess 140 is located in the top surface 130 of the base block 120. The base block 120 has front and rear ends 180 and 200, respectively. The top surface 130 defines an inclined slope 220 which has a positive elevation from the rear end 180 in the direction of the front end 200. The base block 120 defines a bottom base 230. The base block 120 can be made of any suitable material such as, but not limited to, a synthetic material such as a polymer or a natural material such as wood. For example, the base block 120 can be made of polyethylene or expanded polystyrene.

Figure 2:
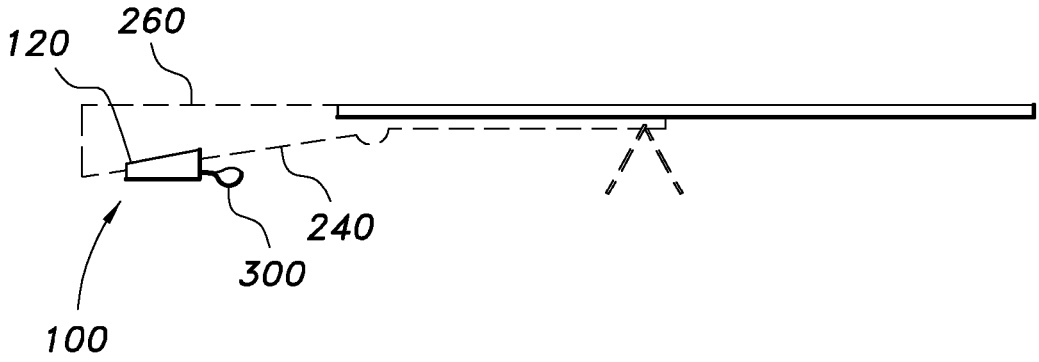
FIG. 2 shows an environmental view of a rear rifle stabilizer according to the invention.
Figure 2A:
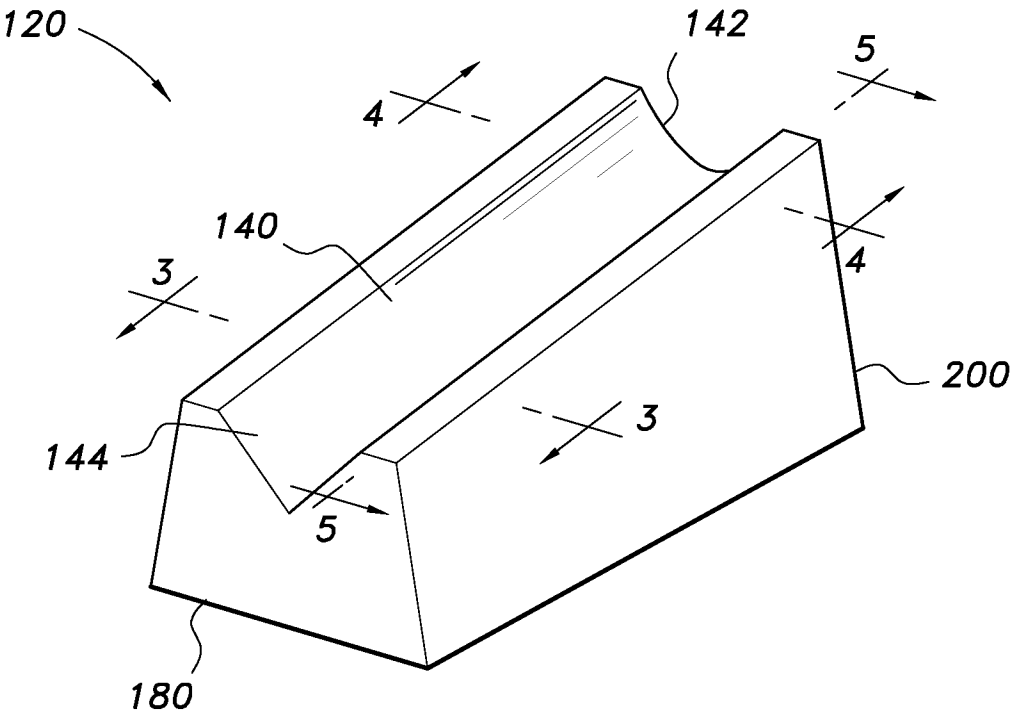
FIG. 2A shows a perspective view of a base block according to the invention.
Figure 4:
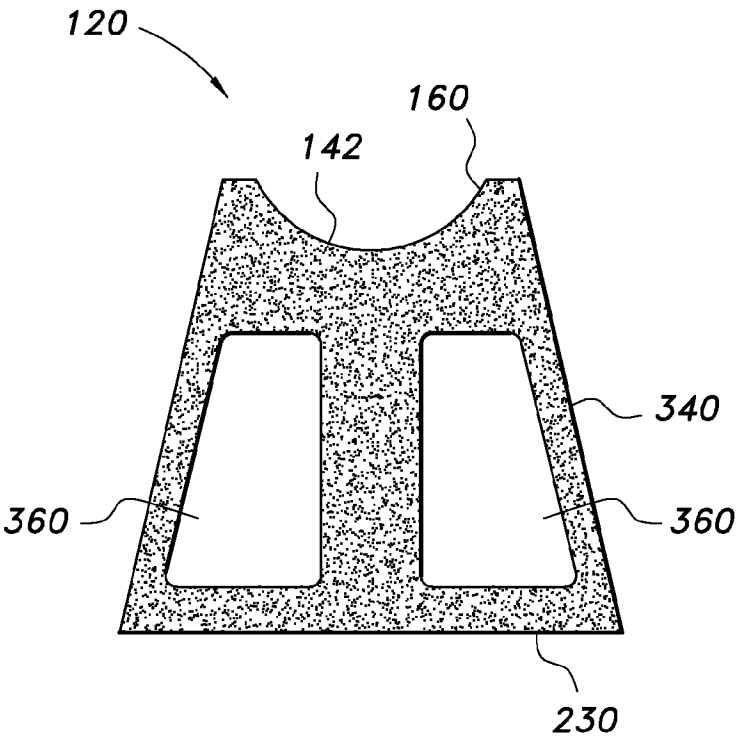
FIG. 4 shows a cross-section view at line 4-4 of the base block shown in FIG. 2A.
Figure 3:
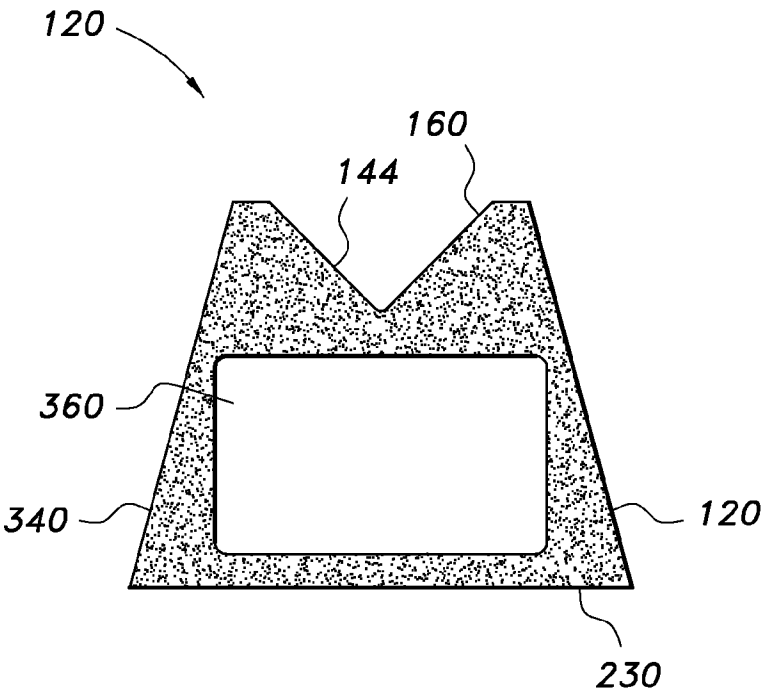
FIG. 3 shows a cross-section view at line 3-3 of the base block shown in FIG. 2A.
Figure 5:
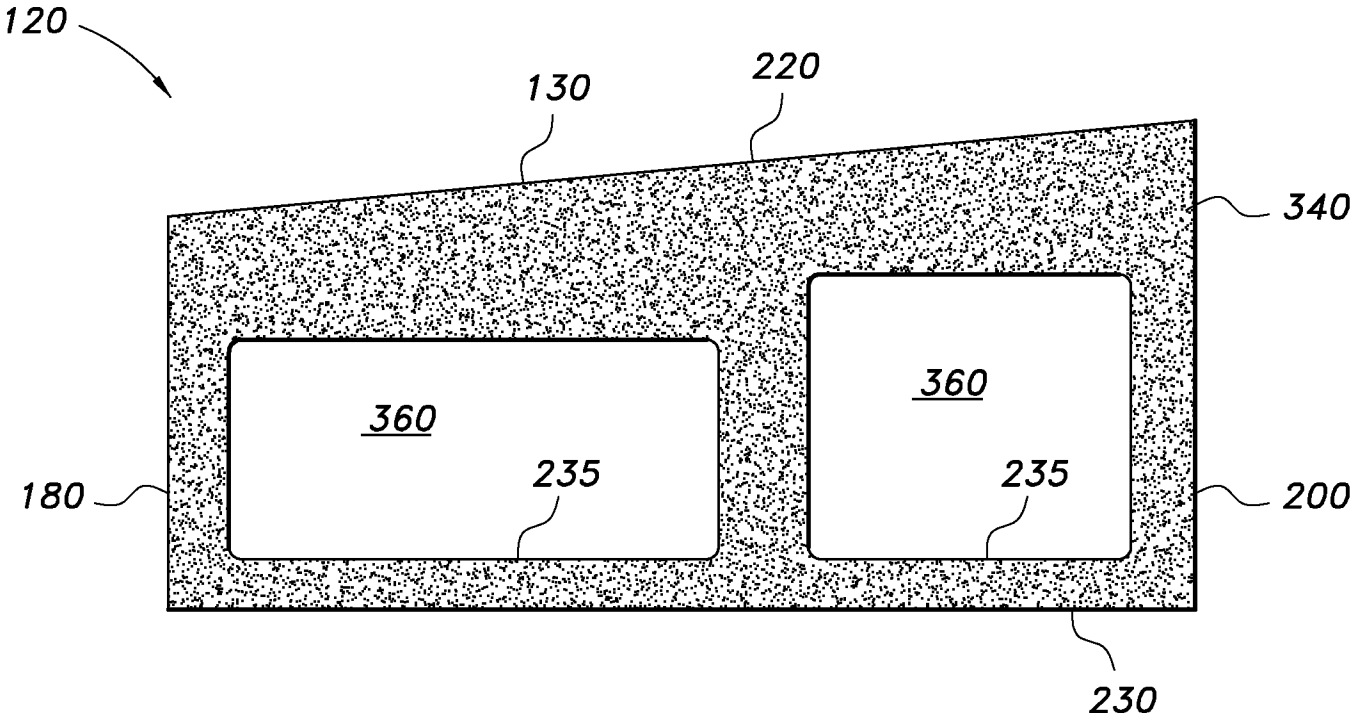
FIG. 5 shows a longitudinal section view at line 5-5 of the base block shown in FIG. 2A.

The recess 140 is contoured to accommodate the lower edge 240 of a rifle's buttstock 260. The recess 140 can have any suitable overall shape; for example, the recess 140 can have a U-shaped cross-section 142, but other suitable cross-section recess shapes can be used such as, but not limited to, a V-shaped cross-section 144. The recess 140 can be V-shaped at one end 180 and U-shaped at the other end 200, and vice versa, as shown in FIG. 2A.

Lining the recess 140 is an air bladder 280 operatively connected to a hand pump 300 and an air release valve 320; the hand pump 300 and release valve 320 enables minor adjustments in the inflation and/or deflation of the air bladder 280 thereby enabling very minor movement of the buttstock 260 which during use rests on the air bladder 280 of the rear rifle stabilizer 100. The air bladder 280 can be a rubber air bladder. The hand pump 300 can be located at any suitable location relative to the air bladder 260 and base block 120. For example, the pump 300 can be located alongside the base block 120 or proximate to the front end 180 or rear end 200 of the base block 120.

The purpose of the air bladder 280 is to give a shooter the ability to make very small adjustments in positive elevation or negative elevation without taking his/her eye away from the sights of a rifle or make any major body movements with respect to the shooter.

When shooting long range (i.e., LR) a 1/60th of a degree movement at the rifle can be an 8 inch movement at a target 800 meters away. The key for accurate multiple target interdiction is a mobile, stable shooting platform that can be adjusted to a fraction of an angle. By diminishing or removing human error and increasing consistency the shooter will be more effective. The controllable air bladder 280 makes such adjustments by means of the hand pump 300 and release valve 320. The hand pump 300 enables the shooter to increase rifle elevation by controllably adding air to the bladder 280; and the release valve 320 enables the shooter to decrease rifle elevation by controllably releasing air from the bladder 280.

In a combat environment any large movement can compromise a shooters position. When shooting at distances greater than 500 meters small adjustments are necessary to find a point of aim in between the sights methods of adjustments. For large quick adjustments the base block 120 can be slid forward by the shooter thereby dropping the rear of the rifle and in turn raising the rifle barrel and vice versa.

The base block 120 can be in the form of a frame 340 which can be made out of any suitable material such as a polymer plastic. The frame 340 can include at least one void 360 to save on material costs and weight. The frame 340 can be covered with a cover made out of any suitable material such as, but not limited to, nylon or leather. A hook-and-loop fastener make up of hooks and loops akin to Velcro® can be attached to the block 120 to secure the air pump 300.

The recess 140 defines a recess surface 160. One or more layers of leather can be deployed between the bladder 280 and recess surface 160 to protect the bladder 280 from wear and tear. A layer of nylon can be deployed between the one or more layers of leather and the recess surface 160.

Figure 6:
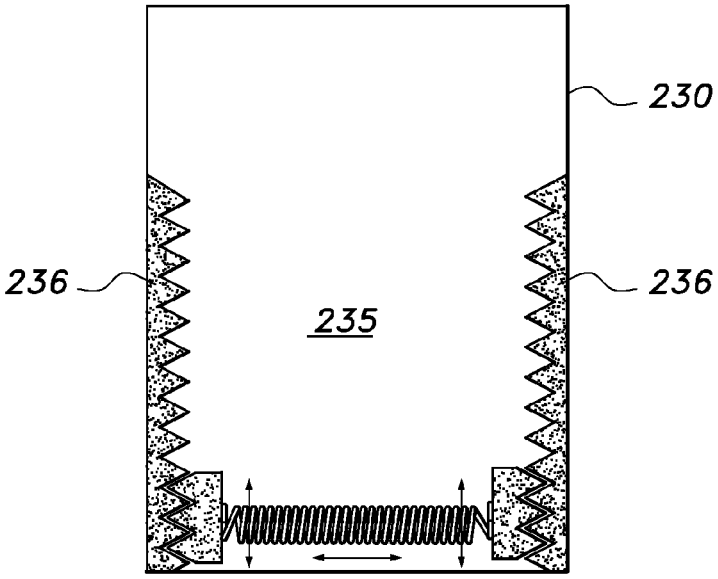
FIG. 6 shows a bottom internal view of a base block according to the invention.
Figure 7:
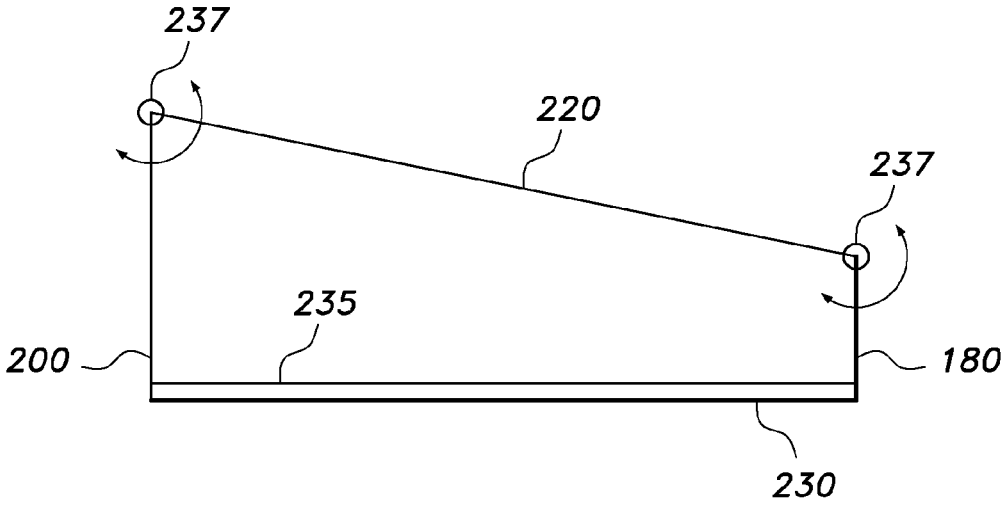
FIG. 7 shows a side view of a base block according to the invention.

Referring to FIG. 6, an interior surface 235 of bottom base 230 can be fitted with a two-way ratchet mechanism 236 to allow the base block 120 to be moved linearly for a predetermined distance in either direction relative to the bottom base 230. Hinges 237 can also be fitted to adjust the orientation of the top surface 130 (see FIG. 7).

A method is also provided to adjust the elevation, and by implication de-elevation, of a rifle buttstock 260, the method comprising the steps of:

providing a rifle having a buttstock 260;

providing a rear rifle stabilizer 100, the rear rifle stabilizer 100 comprising a base block 120 having a top surface 130 and a recess 140 disposed in the top surface 130 of the base block 120, the recess 140 being at least partly lined by an air bladder 280, the air bladder 280 being operatively connected to a hand pump 300 and an air release valve 320;

resting the buttstock 260 on the air bladder 280; and making adjustments to the elevation of the buttstock 260 by making adjustments to the air bladder 280 by means of the hand pump 300 and the air release valve 320.

In summary, the invention provides a stable shooting platform for such activities as Long Range (LR) target interdiction. It is believed that the rear rifle stabilizer (100 of the invention represents an important improvement over prior art apparatus and methods of stabilizing a rifle for accurate fire.

The invention being thus described, it will be evident that the same may be varied in many ways by a routineer in the applicable arts. Such variations are not to be regarded as a departure from the spirit and scope of the invention.

What is claimed:

1. A rear rifle stabilizer for providing controllable adjustments to the orientation of a rifle's buttstock, comprising:

a base block, said base block having front and rear ends and a top surface there-between, said top surface defining a slope having positive elevation from said front end in the direction of said rear end, said top surface further defining a recess therein for accommodating a rifle's buttstock;

an air bladder, said air bladder lining at least a part of said recess;

an air hand pump; and an air release valve, wherein said air bladder is in operable communication with said hand pump and said air release valve such that said hand pump and said release valve enable a shooter to make adjustments in the inflation or deflation of said air bladder to enable adjustments to the orientation of a rifle's buttstock.

2. The rear rifle stabilizer according to claim 1, wherein said air bladder is a rubber air bladder.

3. The rear rifle stabilizer according to claim 1, wherein said base block is made of expanded polystyrene.

4. The rear rifle stabilizer according to claim 1, wherein said base block is made of wood.

5. The rear rifle stabilizer according to claim 1, wherein said recess has a U-shaped cross-section.

6. The rear rifle stabilizer according to claim 1, wherein said recess has a V-shaped cross-section.

7. The rear rifle stabilizer according to claim 1, wherein said base block is constructed in the form of a frame with at least one void therein.

8. The rear rifle stabilizer according to claim 1, wherein said base block comprises a bottom base, and further wherein said bottom base defines an interior surface to which is fitted a two-way ratchet mechanism to allow the base block to be moved linearly for a predetermined distance in either direction relative to the bottom base.

9. A method for adjusting the elevation, and by implication de-elevation, of a rifle buttstock, comprising the steps of:

providing a rifle having a buttstock;

providing a rear rifle stabilizer, said rear rifle stabilizer comprising a base block having a top surface and a recess disposed in the top surface of the base block, said recess being at least partly lined by an air bladder, said air bladder operatively connected to a hand pump and an air release valve;

resting the buttstock on the air bladder; and making adjustments to the elevation of the buttstock by making adjustments to the air bladder by means of the hand pump and the air release valve.

* * * * *